US010777369B2

(12) United States Patent
Ludvik et al.

(10) Patent No.: US 10,777,369 B2
(45) Date of Patent: Sep. 15, 2020

(54) TWIN-ROLL BLOCKING UNIT FOR A TRIGGERING MECHANISM FOR A SWITCHING DEVICE

(71) Applicant: Siemens Aktiengesellschaft, Munich (DE)

(72) Inventors: Godesa Ludvik, Berlin (DE); Bettina Kleinig, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 284 days.

(21) Appl. No.: 15/763,499

(22) PCT Filed: Sep. 9, 2016

(86) PCT No.: PCT/EP2016/071246

§ 371 (c)(1),
(2) Date: Mar. 27, 2018

(87) PCT Pub. No.: WO2017/055053

PCT Pub. Date: Apr. 6, 2017

(65) Prior Publication Data

US 2018/0286601 A1 Oct. 4, 2018

(30) Foreign Application Priority Data

Oct. 1, 2015 (DE) ..... 10 2015 219 041

(51) Int. Cl.
*H01H 3/00* (2006.01)
*H01H 3/30* (2006.01)
*H01H 33/666* (2006.01)

(52) U.S. Cl.
CPC ..... *H01H 3/3031* (2013.01); *H01H 3/3042* (2013.01); *H01H 33/666* (2013.01);
(Continued)

(58) Field of Classification Search
CPC ..... H01H 3/3031; H01H 3/3042; H01H 2235/016; H01H 2003/3036
(Continued)

(56) References Cited

U.S. PATENT DOCUMENTS 4,703,137 A * 10/1987 Bohnen ..... H02B 11/133 200/50.25
2004/0001297 A1* 1/2004 Godesa ..... H01H 1/54 361/115
2009/0201109 A1 8/2009 Hashimoto et al.
2010/0044196 A1* 2/2010 Dahl ..... H01H 77/104 200/244
(Continued)

FOREIGN PATENT DOCUMENTS

CN 2548251 Y 4/2003
CN 101454858 A 6/2009
(Continued)

OTHER PUBLICATIONS

Russian Office Action dated Dec. 6, 2018.
(Continued)

*Primary Examiner* — Shawki S Ismail
*Assistant Examiner* — Lisa N Homza
(74) *Attorney, Agent, or Firm* — Harness, Dickey & Pierce, P.L.C.

(57) ABSTRACT

A triggering mechanism is for a switching device, in particular for low-voltage devices and systems, medium-voltage devices and systems, and/or high-voltage devices and systems. The triggering mechanism includes a lever, equipped with two rolls for blocking purposes.

24 Claims, 5 Drawing Sheets

(52) U.S. Cl.
CPC ..... *H01H 2003/3036* (2013.01); *H01H 2235/016* (2013.01)

(58) Field of Classification Search
USPC ..... 335/77
See application file for complete search history.

(56) References Cited

U.S. PATENT DOCUMENTS

| | | | | |
|---|---|---|---|---|
| 2011/0073446 | A1 | 3/2011 | Marushima et al. | |
| 2013/0126319 | A1* | 5/2013 | Godesa | H01H 21/50 200/321 |

FOREIGN PATENT DOCUMENTS

| | | | |
|---|---|---|---|
| CN | 102034620 | A | 4/2011 |
| CN | 104319196 | A | 1/2015 |
| DE | 29507811 | U1 | 6/1995 |
| EP | 0668600 | A1 | 8/1995 |
| JP | H09180593 | A | 7/1997 |
| RU | 139723 | U1 | 4/2014 |
| SU | 86091 | A1 | 11/1949 |

OTHER PUBLICATIONS

Chinese Office Action dated Dec. 5, 2018.
International Search Report PCT/ISA/210 for International Application No. PCT/EP2016/071246 dated Dec. 2, 2016.
Written Opinion of the International Searching Authority PCT/ISA/237 for International Application No. PCT/EP2016/071246 dated Dec. 2, 2016.
German Office Action #102015219041.2 dated Jun. 14, 2016.

* cited by examiner

TWIN-ROLL BLOCKING UNIT FOR A TRIGGERING MECHANISM FOR A SWITCHING DEVICE

PRIORITY STATEMENT

This application is the national phase under 35 U.S.C. § 371 of PCT International Application No. PCT/EP2016/071246 which has an International filing date of Sep. 9, 2016, which designated the United States of America and which claims priority to German patent application number 102015219041.2 filed Oct. 1, 2015, the entire contents of which are hereby incorporated herein by reference.

FIELD

An embodiment of invention generally relates to a triggering mechanism for a switching device, in particular for low-voltage devices and systems, medium-voltage devices and systems and/or high-voltage devices and systems.

BACKGROUND

The prior art discloses straightforward latching arrangements, for example vacuum contactors. In these, a drive lever is pushed into the "off" switching position via a compression spring. In order for the switching device to be readily retained in the "on" switching position, the drive lever is latched, that is to say blocked, mechanically. For this purpose, a latch block is fastened on the drive lever. In the "on" switch position, the drive lever is blocked by a bolt. The bolt is a constituent part of a lever which is retained in the latched position via a spring and the resulting spring force. It is possible for the blocking unit comprising the bolt and lever to be pulled out of the latched position via a solenoid (triggering magnet) and the magnetic field thereof and thus to free the drive lever, or else the lever and the bolt are pulled mechanically out of the latched position via a rod in order to free the drive lever.

Such a system allows for only very low tolerances, so as to avoid undesired unlatching, that is to say unblocking, of the drive lever.

Even low tolerances result, in such a system, in high levels of friction, in particular between the latch block and bolt.

Overall, the known systems require high triggering forces, for example approximately 100 N in the embodiment described, for mechanical triggering, that is to say unlatching.

It is also the case that high forces are necessary for electromagnetic triggering, or unlatching, for which reason expensive special-production measures are required for the triggering magnets, in other words electromagnets. The high triggering forces necessitate a solid component construction and strong springs. It is also necessary for the lever of the latching arrangement to be welded on account of the high forces, and this results in high-outlay production.

SUMMARY

The inventors have discovered that since the rod is subjected to transverse forces for mechanical triggering purposes, additional mounting is necessary in order for additional frictional forces to be prevented or minimized.

At least one embodiment of the invention provides a triggering mechanism which is more straightforward to produce and more cost-effective and, at the same time, prevents undesired unlatching, that is to say triggering, as a result of, for example, vibration.

At least one embodiment of the invention is directed to a triggering mechanism for a switching device, having a drive lever, a mechanical energy store, which is suitable for acting on the drive lever, and a blocking device. The blocking device preferably has a first blocking element on the drive lever, a lever with a first roller and a second roller, a second blocking element and a triggering element. The first roller and the second roller are mounted in a rotatable manner on the lever.

The second blocking element, in a locked position, acts on the first roller such that the lever is blocked against moving in the direction of the second blocking element, that is to say also in the direction of the third point of rotation, in other words the point of rotation of the second blocking element.

The second roller acts on the first blocking element such that the first blocking element is blocked against moving away from the mechanical energy store or in the direction of the mechanical energy store.

The expression "locked position" relates both to the lever being blocked against moving in the direction of the second blocking element and to the first blocking element being blocked against moving away from the mechanical energy store or in the direction of the mechanical energy store.

The second blocking element can be moved via the triggering element such that the second blocking element moves away, out of the locked position, from the first roller and the lever with the first roller and the second roller moves away out of the locked position, in which the first blocking element is blocked against moving away from the mechanical energy store or in the direction of the mechanical energy store, and therefore the first blocking element can roll over the second roller and the drive lever can be moved, by the energy stored in the mechanical energy store, away from the mechanical energy store or in the direction of the same.

BRIEF DESCRIPTION OF THE DRAWINGS

The subject matter of the invention will be explained in more detail hereinbelow with reference to individual figures, in which.

DETAILED DESCRIPTION OF THE EXAMPLE EMBODIMENTS

Figure 1:
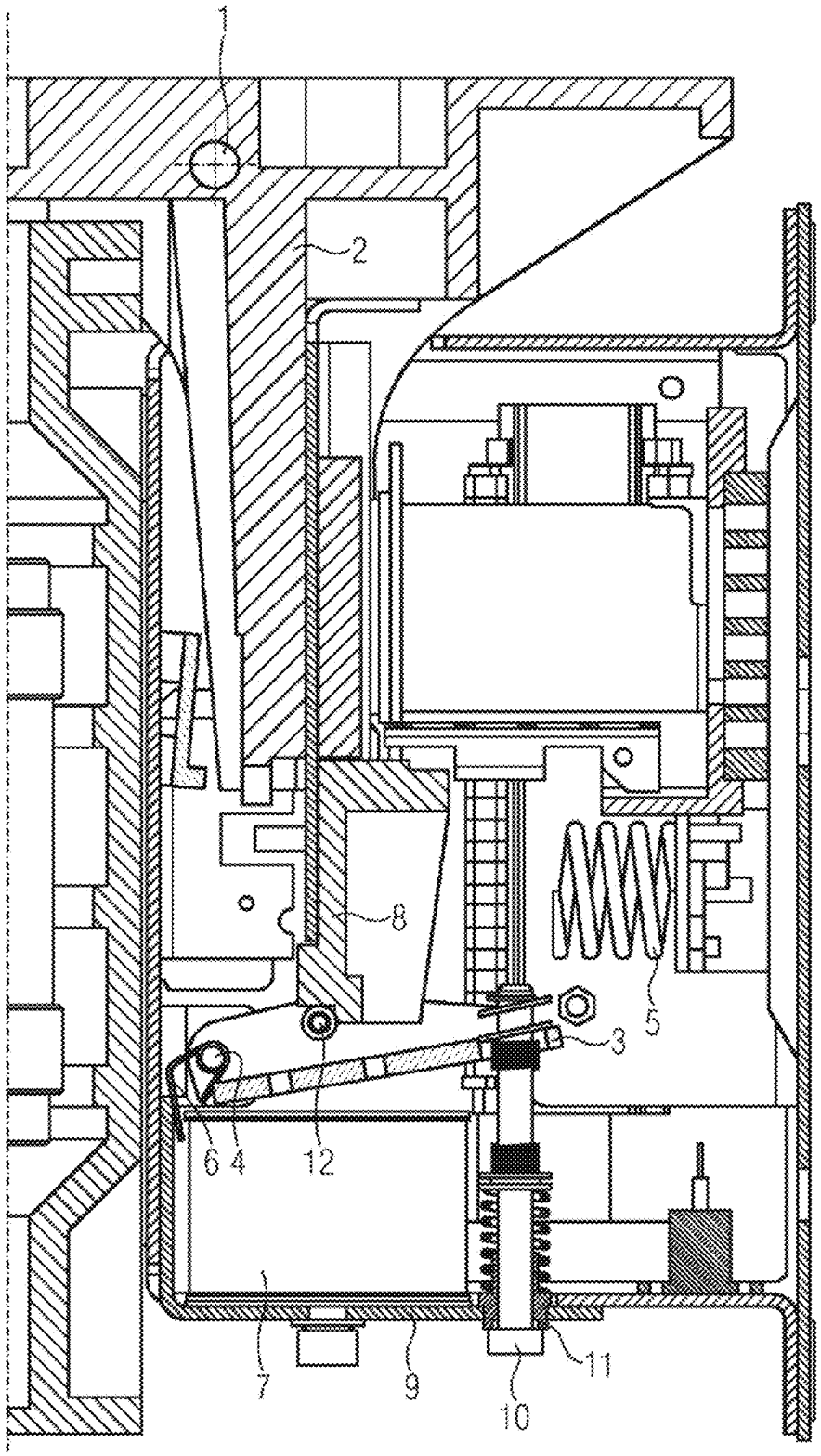
FIG 1 PRIOR ART
FIG. 1 shows a sectional view of a latching arrangement from the prior art.

At least one embodiment of the invention is directed to a triggering mechanism for a switching device, having a drive lever, a mechanical energy store, which is suitable for acting on the drive lever, and a blocking device. The blocking device preferably has a first blocking element on the drive lever, a lever with a first roller and a second roller, a second blocking element and a triggering element. The first roller and the second roller are mounted in a rotatable manner on the lever.

The second blocking element, in a locked position, acts on the first roller such that the lever is blocked against moving in the direction of the second blocking element, that is to say also in the direction of the third point of rotation, in other words the point of rotation of the second blocking element.

The second roller acts on the first blocking element such that the first blocking element is blocked against moving away from the mechanical energy store or in the direction of the mechanical energy store.

The expression "locked position" relates both to the lever being blocked against moving in the direction of the second blocking element and to the first blocking element being blocked against moving away from the mechanical energy store or in the direction of the mechanical energy store.

The second blocking element can be moved via the triggering element such that the second blocking element moves away, out of the locked position, from the first roller and the lever with the first roller and the second roller moves away out of the locked position, in which the first blocking element is blocked against moving away from the mechanical energy store or in the direction of the mechanical energy store, and therefore the first blocking element can roll over the second roller and the drive lever can be moved, by the energy stored in the mechanical energy store, away from the mechanical energy store or in the direction of the same.

In at least one embodiment, such a triggering mechanism makes it possible for a switch to be reliably retained in an "on" position but to be transferrable, by the mechanical energy store loaded with energy, quickly and reliably into an "off" position, by virtue of the latching arrangement being unlatched by a triggering element, that is to say by a locking arrangement being released and unlocked.

An example embodiment of a triggering mechanism for a switching device is one in which the mechanical energy store is a spring element, further preferably a compression spring.

Another example embodiment of a triggering mechanism for a switching device is one in which the drive lever is mounted in a rotatable manner at a first point of rotation, and the lever is mounted in a rotatable manner at a second point of rotation and the second roller is arranged between the second point of rotation and the first roller. The second blocking element is mounted in a rotatable manner at a third point of rotation.

On that side of the third point of rotation which is directed away from the first roller and on the side which is directed toward the triggering element, the second blocking element butts against a stop which prevents that side of the second blocking element which is directed toward the first roller from rotating in the direction away from the second roller. The second blocking element can be made to rotate by the triggering element such that that side of the second blocking element which is directed toward the first roller, as seen from the third point of rotation, moves away from the first roller and in the direction of the second roller and—if necessary—also moves onward past the second roller, and therefore the lever moves in the direction of the third point of rotation, and the first blocking element rolls over the second roller and thus releases the first blocking element, it therefore being the case that the drive lever is caused to rotate, by the compression spring or the mechanical energy store, about the first point of rotation.

Another example embodiment of a triggering mechanism for a switching device is one in which the second blocking element is prestressed by a mechanical force by way of a rotary spring.

A further example embodiment is a triggering mechanism for a switching device in which the second blocking element is additionally secured against rotation by a mechanical force by way of a rotary spring and, in an unlocked position, subjects the blocking element to a restoring force in the direction of the locked position, wherein the unlocked position is distinguished in that the lever is not blocked against moving in the direction of the second blocking element, and in that the first blocking element is not blocked against moving away from the mechanical energy store or in the direction of the mechanical energy store.

A further example embodiment includes a triggering mechanism for a switching device in which the second roller is offset on the lever in the direction of the drive lever, as seen in relation to the first roller.

A further example embodiment includes a triggering mechanism for a switching device in which, in the locked position, the second blocking element, on the side directed away from the first roller, has been tilted in the direction of the stop by 0.2° to 0.5° in relation to a vertical axis, that is to say the long axis of the second blocking element when oriented vertically. In other words: in the locked position, in which the latch and/or the second blocking element butt/butts against the stop, the axis of the latch and/or of the second blocking element tilts by 0.2° to 0.5°, to be precise such that that side of the blocking element which, as seen from the third point of rotation, is directed away from the first roller has been rotated in the direction of the second roller. In particular, it is possible for the axis in relation to which the second blocking element has been tilted also to be formed by the axis through the third point of rotation and the point of rotation of the first roller.

A further example embodiment includes a triggering mechanism for a switching device is also one in which those edges of the second blocking element which are directed toward the first roller in the locked position are rounded.

In a further example embodiment, the first roller and second roller have different diameters.

A further example embodiment includes a triggering mechanism for a switching device in which the triggering element is a triggering magnet, in particular an electromagnet or a coil, in particular a solenoid.

A further example embodiment includes a triggering mechanism for a switching device in which the triggering magnet can be actuated both mechanically and electrically.

A further example embodiment includes a triggering mechanism for a switching device in which the necessary force for triggering the mechanical unlocking of the second blocking element via the triggering element is smaller than 50 N, preferably smaller than 30 N, preferably smaller than 25 N, and is further preferably 20 N (+/−) 2 N.

In a further example embodiment for a triggering mechanism for a switching device, the second blocking element is a latch or half-shaft.

FIG. 1 shows a latching arrangement and the associated triggering mechanism from the prior art, for example the Siemens 3TLG vacuum contactor. The drive lever 2, with the point of rotation 1, is pushed in the direction of the "off" switching position via a compression spring 5. In order for the drive lever 2 and thus the switching device to be retained in the "on" switching position, the drive lever 2 is latched mechanically.

This latching takes place via a latch block 8, which is fastened on the drive lever 2. This latch block 8 is blocked in the "on" switching position by the bolt 12.

The bolt 12 is a constituent part of the lever 3, wherein the lever 3 is retained in the latched position by way of the force of the rotary spring 6.

For unlatching purposes, that is to say in order to trigger the switch so that the latter can pass into the "off" switching position, either the solenoid 7 is energized, the magnetic field of the solenoid 7 pulling the lever 3 out of the latched position and thus freeing the drive lever 2, or the lever 3 is pulled mechanically out of the locking position by the rod 10, the bolt 12, in turn, therefore freeing the latch block 8 and thus the lever 3.

In order for undesirable forces to be reduced, the rod 10 is guided in a bearing 11.

Also shown is a shim 9 beneath the solenoid.

Figure 2:
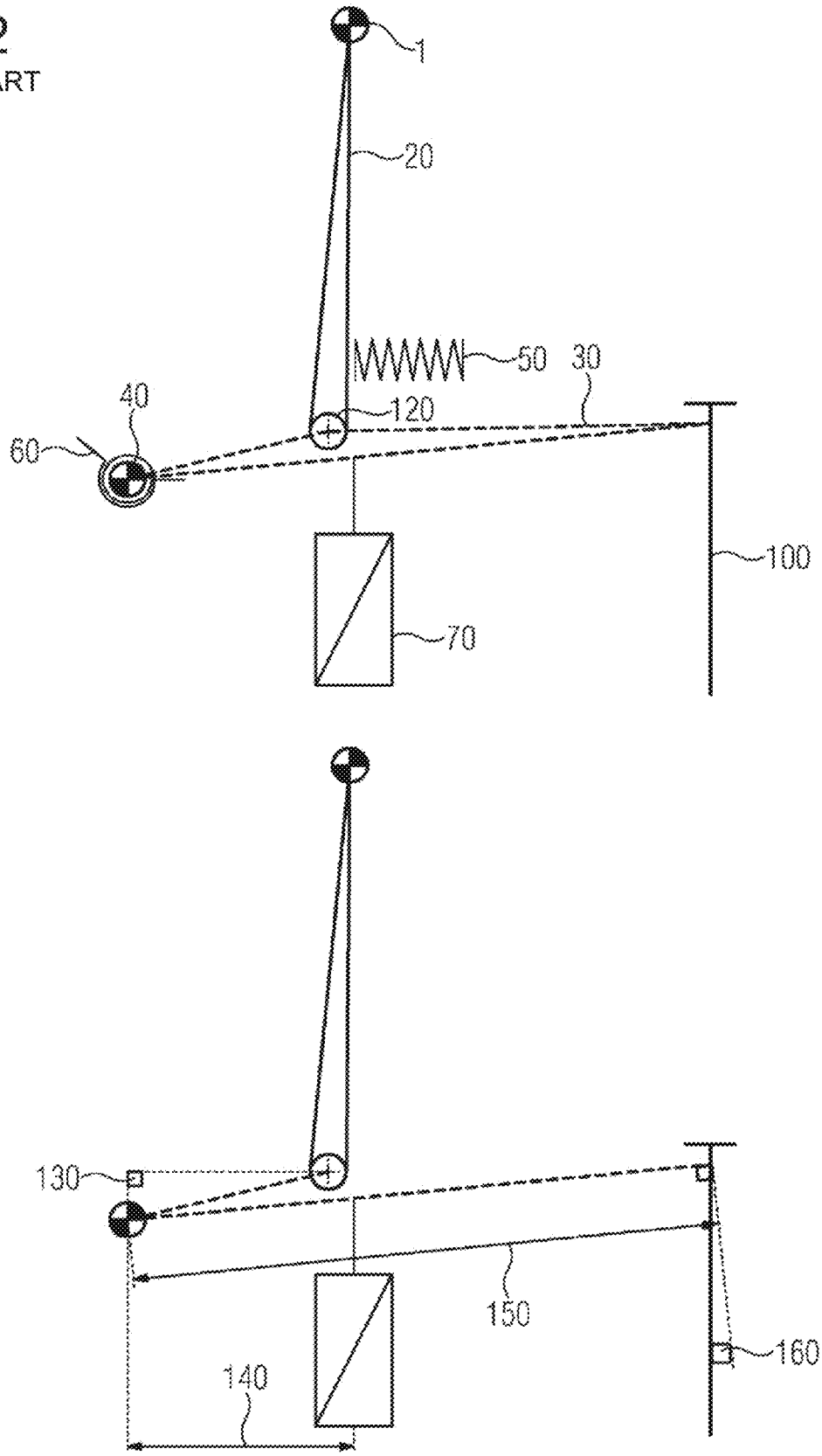
FIG 2 PRIOR ART
FIG. 2 shows a schematic drawing of the levers and forces for a latching arrangement according to FIG. 1.

FIG. 2 shows schematically, in the upper part, the basic construction of the triggering device according to the prior art.

The drive lever 20 is mounted in a rotatable manner at the point of rotation of the drive lever 1. The compression spring 50 acts on the drive lever 20. The drive lever 20 is retained in the "on" position by the bolt 120 as long as the switch is located in the "on"/latched switch position.

The bolt 120 is fastened on the lever 30 and the lever 30 is mounted in a rotatable manner at the point of rotation 40, and the rotary spring 60 retains the lever in the latched position, or pushes it into said position.

The lever 30 can be moved out of the locked position either via the rod 100 or via the solenoid 70, and therefore the drive lever 20 is freed and can be moved by the compression spring 50.

The lower part of FIG. 2 likewise shows the drive lever 20 in the locked position, wherein the lever arm of the bolt 130, the lever arm of the coil 140, the lever arm of the rod 150 and the transverse force 160 are shown.

Figure 3:
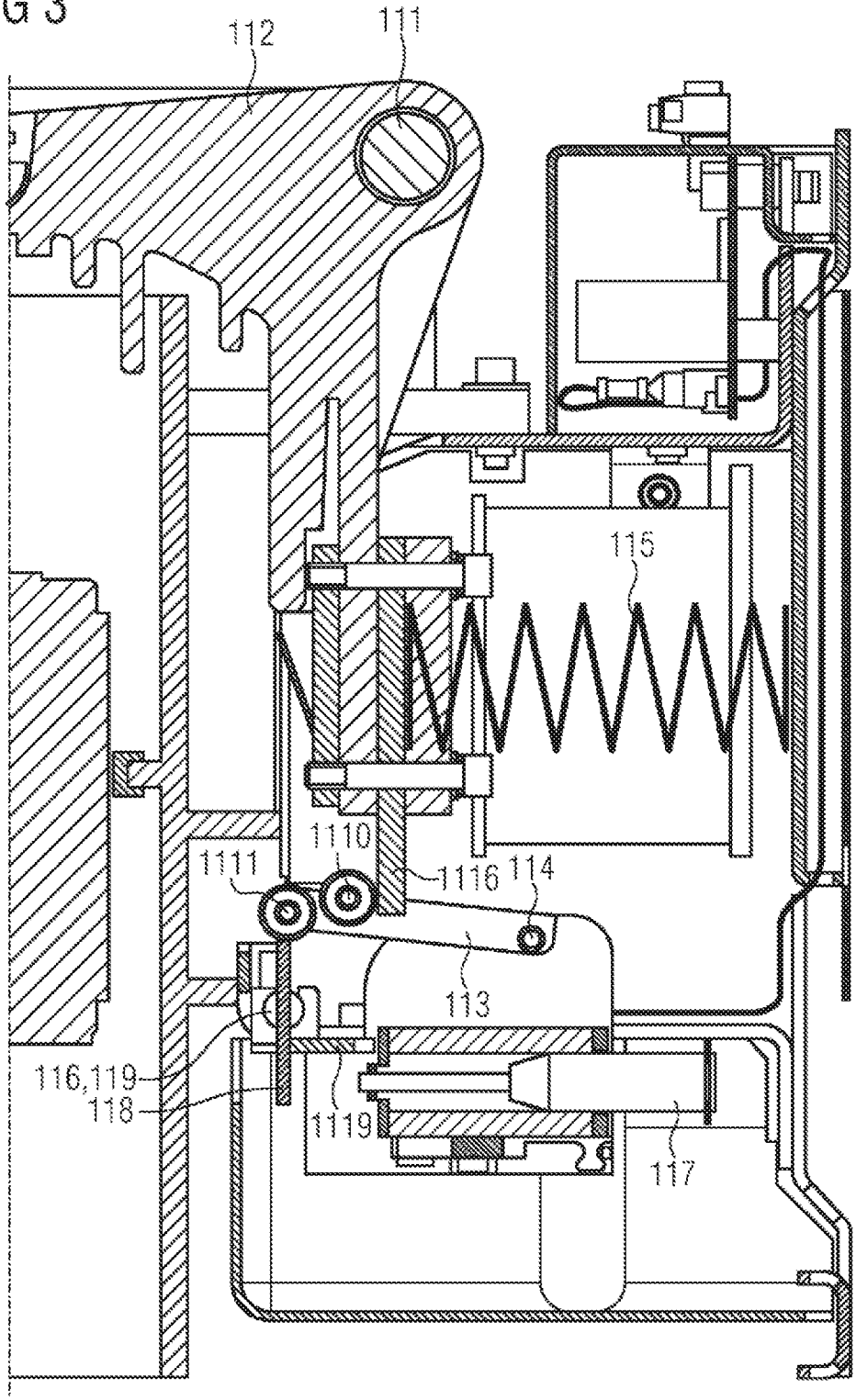
FIG. 3 shows a section through a triggering device and latching arrangement according to an embodiment of the invention.

FIG. 3 shows a section through a triggering mechanism according to the invention. The drive lever 112 is mounted in a rotatable manner at a point of rotation of the drive lever 111. In the "on" switching position, the drive lever 112 is blocked by the second roller 1110, via the first blocking element 1116, which may be designed in the form of a latch, from moving away from the mechanical energy store, in this case a compression spring 115. The blocking element 1116 is fixed to the drive lever 112. The second roller 1110 is mounted in a rotatable manner on the lever 113. The lever 113 itself is mounted in a rotatable manner at the point of rotation of the lever 113, in other words the second point of rotation 114.

In the locked position, that is to say in the "on"/latched switching position of the switch, the lever 113 is prevented by a second blocking element 118, via the first roller 1111 mounted in a rotatable manner on the lever 113, from moving away from the first blocking element 1116. The second blocking element 118 is located beneath the third point of rotation 119, on which the second blocking element 118 is mounted in a rotatable manner, and, on that side which is directed toward the point of rotation of the lever 113, that is to say the second point of rotation 114, butts against a stop 1119. It is also possible for the stop 1119, in principle (not shown here), to be provided above the third point of rotation 119, on which the second blocking element 118 is mounted in a rotatable manner, and on that side of the second blocking element 118 which is directed away from the point of rotation of the lever 113, that is to say the second point of rotation 114.

For triggering or unlatching purposes, it is possible for the triggering element 117 to cause the second blocking element 118 to move, or rotate, either mechanically or electronically. As a result of this movement, the second blocking element 118 moves away from the first roller 1111 and thus frees the lever 113. In particular, it is possible for that end of the second blocking element 118 which is directed toward the first roller 1111 to move away from the first roller 1111 and in the direction of the second roller 1110, and—if necessary—also to move onward past the second roller 1110. The freed lever 113 is moved in the direction of the second blocking element 118 and thus allows the first blocking element 1116 to roll over the second roller 1110 of the lever 113. The thus freed, unlatched or unlocked drive lever 112 can then be rotated by the mechanical energy store 115, in this case a compression spring 115, about the point of rotation 111 of the drive lever and thus move the switch into an "off" position.

In the case of the switch being transferred into the "on" position, a rotary spring 116 at the point of rotation of the second blocking element 118, that is to say the third point of rotation 119, causes the second blocking element 118 to be rotated back again into the latched or blocked position, which enables, or moves, the lever 113 to block the first blocking element 1116.

Figure 4:
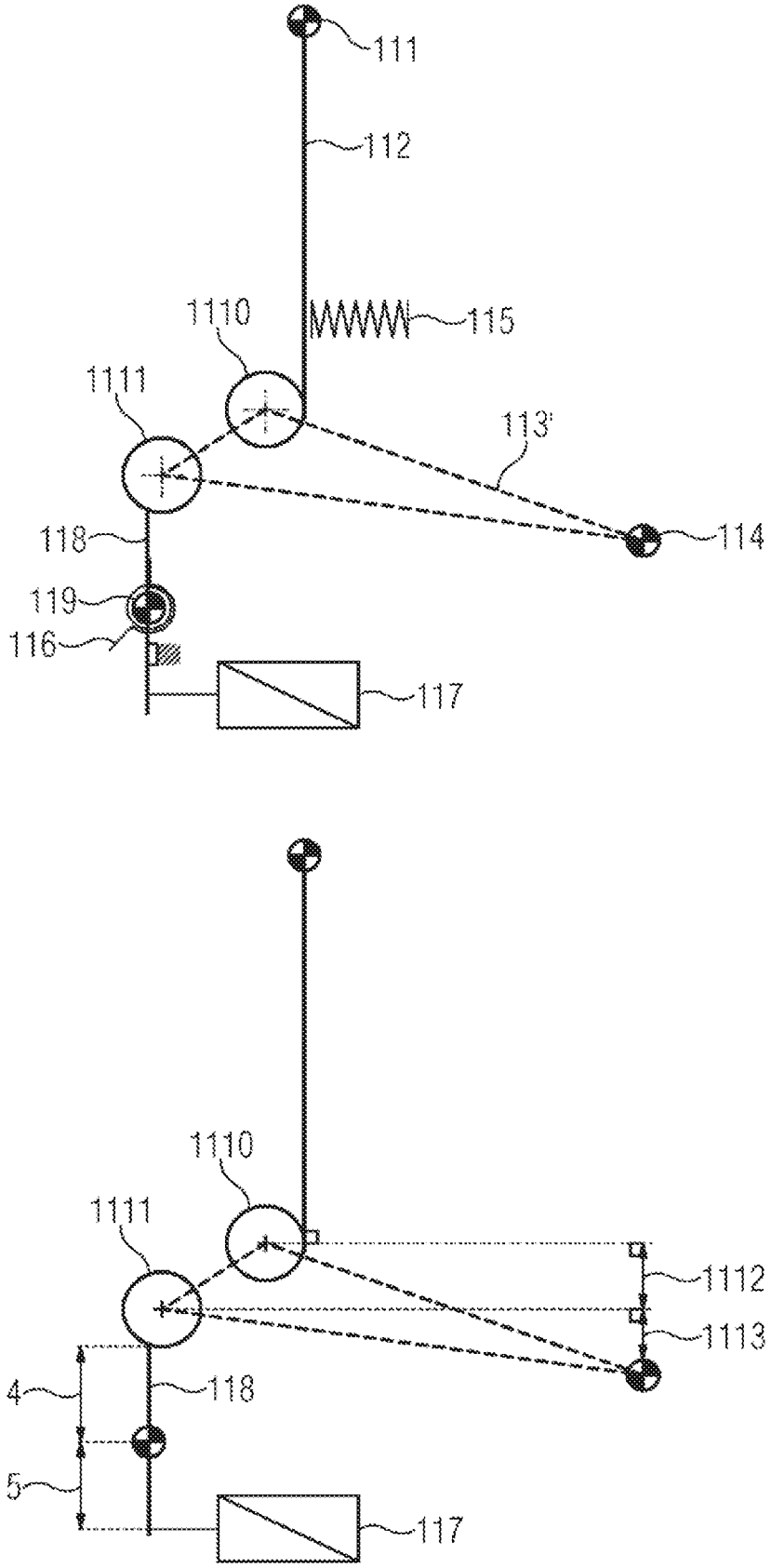
FIG. 4 shows a schematic illustration of the latching arrangement and triggering arrangement, and of the lever arms, according to FIG. 3.

The upper part of FIG. 4 shows the construction of FIG. 3 in a schematic representation. The drive lever 112 is mounted in a rotatable manner at the point of rotation 111 of the drive lever. The drive lever 112 is blocked by the second roller 1110 and the spring 115 is prevented from pushing the drive lever 112 out of the blocked position. The second roller 1110 is connected to the point of rotation of the lever 113, that is to say the second point of rotation 114, via the lever arm 113'. The first roller 1111 is also fastened on the lever 113, and the lever 113 is prevented by the second blocking element 118, which acts on the first roller 1111, from moving in the direction of the second blocking element 118. The second blocking element 118 is mounted in a rotatable manner, by way of the rotary spring 116, at the point of rotation of the second blocking element 118, that is to say the third point of rotation 119. The triggering element 117 is provided such that it can act on the second blocking element 118 and, via a rotary movement of the second blocking element 118 being initiated, can free the lever 113 and thus the drive lever 112.

The lower part of FIG. 4 illustrates the lever arms in respect of the lever 113 and of the second blocking element 118. The lever arm 1113 of the first roller 1111 and the lever arm 1112 of the second roller 1110 are likewise indicated, as are the lever arm 1114 of the second blocking element 118 and the lever arm 1115 of the triggering element 117.

Figure 5:
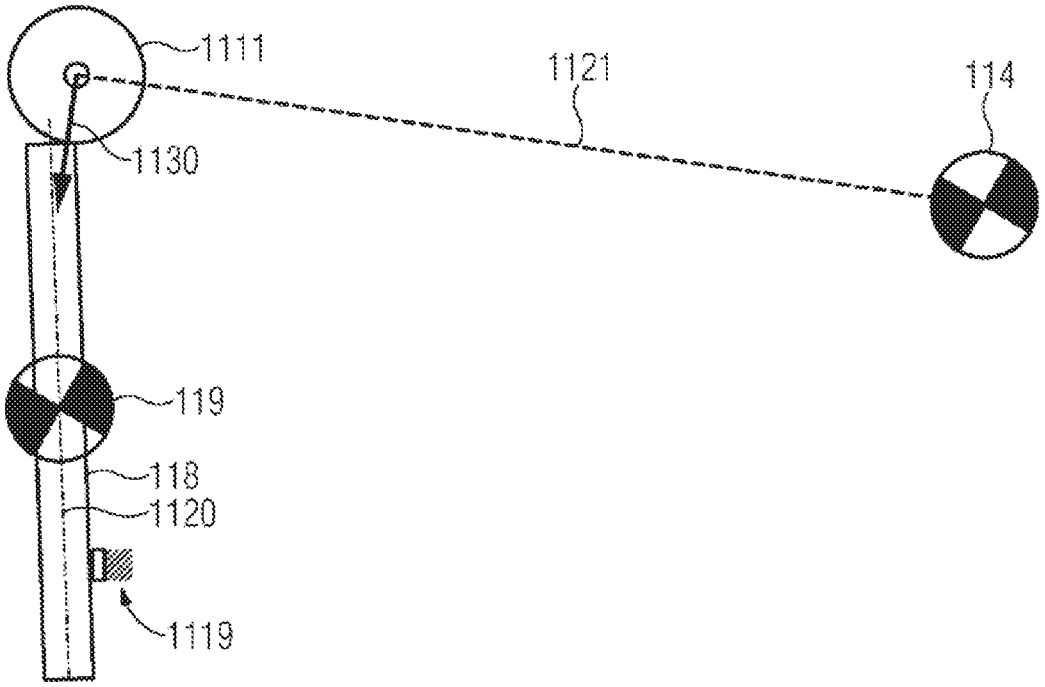
FIG. 5 shows a schematic illustration of the tilting of the second blocking element.

FIG. 5 shows a schematic diagram of the latched state of the second blocking element 118, which, for self-locking purposes, has been tilted or "over-extended" by 0.2° to 0.5°. The figure shows the axis 1121 of the lever 113 and the point of rotation of the lever 113, that is to say the second point of rotation 114, and the first roller 1111, which is retained in the locked or latched position by the second blocking element 118. The second blocking element 118 has been tilted at the third point of rotation 119 of the second blocking element 118 so as to result in self-locking. This self-locking is achieved in that the point of rotation of the first roller 1111 is located along an axis with the third point of rotation 119 of the second blocking element 118, and the stop 1119 of the second blocking element 118 is provided such that, in the latched or locked position, the axis of the latch has been rotated 0.2° to 0.5° in relation to the common axis of the first roller 1111 and of the third point of rotation 119 of the second blocking element 118. The rotation takes place, from the third point of rotation 119, on that side of the second blocking element 118 which is directed toward the first roller 1111 and in the direction which is directed away from the point of rotation 114 of the lever 113. Also shown is the force vector 1130, which results from the rotation and is responsible for the self-locking, that is to say the "over-extension".

LIST OF REFERENCE SIGNS

1 Point of rotation of the drive lever 2
2, 20 Drive lever
3 Lever
4, 30 Point of rotation of the lever
5, 50 Mechanical energy store, spring, compression spring
6, 60 Rotary spring
7, 70 Solenoid
8 Latch block
9 Shim
10, 100 Rod
11 Bearing
12, 120 Bolt
130 Lever arm of the bolt
140 Lever arm of solenoid
150 Lever arm of rod
160 Transverse force
111 Point of rotation of the drive lever 112, first point of rotation
112 Drive lever
113 Lever
114 Point of rotation of the lever 113, second point of rotation
115 Mechanical energy store, spring, compression spring
116 Rotary spring at the point of rotation of the lever 113
117 Triggering element, triggering magnet, electromagnet
118 Second blocking element, latch
119 Point of rotation of the second blocking element, third point of rotation
1110 Second roller
1111 First roller
1112 Lever arm of the first roller
1113 Lever arm of the second roller
1114 Lever arm of the second blocking element, of the latch
1115 Lever arm of the triggering element
1116 First blocking element
1119 Stop of the second blocking element, of the latch
1120 Axis of the second blocking element, of the latch
1130 Resultant force vector
A Tilting by 0.2° to 0.5°, over-extension for self-locking
B Direction for the mechanical triggering, unlatching

The invention claimed is:

1. A triggering mechanism for a switching device, comprising:
a drive lever;
a mechanical energy store, suitable to act on the drive lever; and
a blocking device including
a first blocking element on the drive lever,
a lever including a first roller and a second roller, the first roller and the second roller being mounted in a rotatable manner on the lever,
a second blocking element, the second blocking element, in a locked position, being configured to act on the first roller to block the lever against moving in a direction of the second blocking element, and
a triggering element;
wherein the second roller is configured to act on the first blocking element to block the first blocking element against moving away from the mechanical energy store or in a direction of the mechanical energy store,
wherein the second blocking element is movable via the triggering element, the triggering element being configured to move the second blocking element away, out of the locked position, from the first roller,
wherein the lever, including the first roller and the second roller, is configured to move away out of the locked position, in which the first blocking element is blocked against moving away from the mechanical energy store or in the direction of the mechanical energy store, and
wherein the first blocking element is configured to roll over the second roller and the drive lever is configured to be moved, by energy stored in the mechanical energy store, away from the mechanical energy store or in the direction of the mechanical energy store.

2. The triggering mechanism of claim 1, wherein the mechanical energy store is a compression spring.

3. The triggering mechanism of claim 2, wherein
the drive lever is mounted in a rotatable manner at a first point of rotation,
the lever is mounted in a rotatable manner at a second point of rotation and
the second roller is arranged between the second point of rotation and the first roller,
wherein the second blocking element is mounted in a rotatable manner at a third point of rotation,
wherein, on a side of the third point of rotation directed away from the first roller, the second blocking element is configured to butt against a stop to prevent a side of the second blocking element, directed toward the first roller, from rotating in the direction away from the second roller,
wherein the second blocking element is configured to rotate, via the triggering element, such that that the side of the second blocking element, directed toward the first roller, is configured to move away from the first roller and move in a direction of the second roller, and the lever is configured to move in a direction of the third point of rotation, and
wherein the first blocking element is configured to roll over the second roller and free the first blocking element such that the drive lever becomes rotatable via the compression spring, about the first point of rotation.

4. The triggering mechanism of claim 3, wherein the second blocking element is additionally secured against rotation by a mechanical force via a rotary spring and, in an unlocked position, is configured to subject the second blocking element to a restoring force in a direction of the locked position, and wherein the unlocked position is distinguished in that the lever is not blocked against moving in the direction of the second blocking element and in that the first blocking element is not blocked against moving away from the compression spring or in the direction of the compression spring.

5. The triggering mechanism of claim 1, wherein
the drive lever is mounted in a rotatable manner at a first point of rotation,
the lever is mounted in a rotatable manner at a second point of rotation and
the second roller is arranged between the second point of rotation and the first roller,
wherein the second blocking element is mounted in a rotatable manner at a third point of rotation,
wherein, on a side of the third point of rotation directed away from the first roller, the second blocking element is configured to butt against a stop to prevent a side of the second blocking element, directed toward the first roller, from rotating in the direction away from the second roller, wherein the second blocking element is configured to rotate, via the triggering element, such that that the side of the second blocking element, directed toward the first roller, is configured to move away from the first roller and move in a direction of the second roller, and the lever is configured to move in a direction of the third point of rotation, and wherein the first blocking element is configured to roll over the second roller and free the first blocking element such that the drive lever becomes rotatable via the mechanical energy store, about the first point of rotation.

6. The triggering mechanism of claim 5, wherein, in the locked position, the second blocking element, on the side directed away from the first roller, is tilted in the direction of the stop by 0.2° to 0.5° in relation to a vertical axis.

7. The triggering mechanism of claim 5, wherein the second blocking element is additionally secured against rotation by a mechanical force via a rotary spring and, in an unlocked position, is configured to subject the second blocking element to a restoring force in a direction of the locked position, and wherein the unlocked position is distinguished in that the lever is not blocked against moving in the direction of the second blocking element and in that the first blocking element is not blocked against moving away from the mechanical energy store or in the direction of the mechanical energy store.

8. The triggering mechanism of claim 5, wherein edges of the second blocking element, directed toward the locked position of the first roller, are rounded.

9. The triggering mechanism of claim 5, wherein the first roller and second roller include different diameters.

10. The triggering mechanism of claim 1, wherein the second blocking element is prestressed by a mechanical force via a rotary spring.

11. The triggering mechanism of claim 10, wherein the second blocking element is additionally secured against rotation by a mechanical force via a rotary spring and, in an unlocked position, is configured to subject the second blocking element to a restoring force in a direction of the locked position, and wherein the unlocked position is distinguished in that the lever is not blocked against moving in the direction of the second blocking element and in that the first blocking element is not blocked against moving away from the mechanical energy store or in the direction of the mechanical energy store.

12. The triggering mechanism of claim 1, wherein the second blocking element is additionally secured against rotation by a mechanical force via a rotary spring and, in an unlocked position, is configured to subject the second blocking element to a restoring force in a direction of the locked position, and wherein the unlocked position is distinguished in that the lever is not blocked against moving in the direction of the second blocking element and in that the first blocking element is not blocked against moving away from the mechanical energy store or in the direction of the mechanical energy store.

13. The triggering mechanism of claim 1, wherein the second roller is offset on the lever in the direction of the drive lever, in relation to the first roller.

14. The triggering mechanism of claim 1, wherein edges of the second blocking element, directed toward the locked position of the first roller, are rounded.

15. The triggering mechanism of claim 1, wherein the first roller and second roller include different diameters.

16. The triggering mechanism of claim 1, wherein the triggering element is a triggering magnet.

17. The triggering mechanism of claim 16, wherein the triggering magnet is actuatable both mechanically and electrically.

18. The triggering mechanism of claim 17, wherein a necessary force for triggering mechanical unlocking of the second blocking element via the triggering element is smaller than 50 N.

19. The triggering mechanism of claim 18, wherein the necessary force for triggering mechanical unlocking of the second blocking element via the triggering element is smaller than 30 N.

20. The triggering mechanism of claim 18, wherein the necessary force for triggering mechanical unlocking of the second blocking element via the triggering element is smaller than 25 N.

21. The triggering mechanism of claim 18, wherein the necessary force for triggering mechanical unlocking of the second blocking element via the triggering element is 20 N (+/−) 2 N.

22. The triggering mechanism of claim 16, wherein the triggering magnet is an electromagnet.

23. The triggering mechanism of claim 1, wherein the second blocking element is a latch or half-shaft.

24. The triggering mechanism of claim 1, wherein the second blocking element is prestressed by a mechanical force via a rotary spring.

* * * * *